US011433393B2

(12) United States Patent
Weber

(10) Patent No.: US 11,433,393 B2
(45) Date of Patent: Sep. 6, 2022

(54) MICROFLUIDIC FLOW CELL COMPRISING AN INTEGRATED ELECTRODE, AND METHOD FOR MANUFACTURING SAME

(71) Applicant: THINXXS MICROTECHNOLOGY AG, Zweibrücken (DE)

(72) Inventor: Lutz Weber, Zweibrücken (DE)

(73) Assignee: THINXXS MICROTECHNOLOGY GMBH, Zweibrücken (DE)

( * ) Notice: Subject to any disclaimer, the term of this patent is extended or adjusted under 35 U.S.C. 154(b) by 744 days.

(21) Appl. No.: 16/070,125

(22) PCT Filed: Dec. 28, 2016

(86) PCT No.: PCT/EP2016/082748
§ 371 (c)(1),
(2) Date: Jul. 13, 2018

(87) PCT Pub. No.: WO2017/129340
PCT Pub. Date: Aug. 3, 2017

(65) Prior Publication Data

US 2019/0022646 A1 Jan. 24, 2019

(30) Foreign Application Priority Data

Jan. 26, 2016 (EP) ..... 16152755

(51) Int. Cl.
*B01L 3/00* (2006.01)

(52) U.S. Cl.
CPC ... *B01L 3/502715* (2013.01); *B01L 3/502707* (2013.01); *B01L 2200/0689* (2013.01);
(Continued)

(58) Field of Classification Search
CPC ..... B01L 3/502715; B01L 3/502707; B01L 2200/0689; B01L 2300/042;
(Continued)

(56) References Cited

U.S. PATENT DOCUMENTS 6,287,438 B1 9/2001 Knoll
9,927,421 B2 3/2018 Zantl et al.
(Continued)

FOREIGN PATENT DOCUMENTS

CN 103217466 A 7/2013
DE 19602861 A1 7/1997
(Continued)

OTHER PUBLICATIONS

Stack Plastics Inc. https://www.stackplastics.com/peek, accessed through archive.org, dated May 8, 2013 (Year: 2013).*
(Continued)

*Primary Examiner* — Samuel P Siefke
*Assistant Examiner* — Quocan B Vo
(74) *Attorney, Agent, or Firm* — Lucas & Mercanti, LLP; Klaus P. Stoffel

(57) ABSTRACT

A microfluidic flow cell including an electrode or sensor device which is located inside the flow cell and from which at least one connecting conductor leads to an externally accessible terminal contact. The electrode or sensor device is arranged on an insulated substrate member. The connecting conductor is embedded in the substrate member. The substrate member can be inserted into an opening in the flow cell such that the electrode or sensor device is placed in the flow cell.

17 Claims, 6 Drawing Sheets

(52) U.S. Cl.
CPC ... *B01L 2300/042* (2013.01); *B01L 2300/046* (2013.01); *B01L 2300/0645* (2013.01); *B01L 2300/0663* (2013.01); *B01L 2300/0877* (2013.01)

(58) Field of Classification Search
CPC ..... B01L 2300/046; B01L 2300/0645; B01L 2300/0663; B01L 2300/0877
See application file for complete search history.

(56) References Cited

U.S. PATENT DOCUMENTS

| | | | | |
|---|---|---|---|---|
| 2002/0176804 | A1* | 11/2002 | Strand | G16H 10/65 422/400 |
| 2009/0042280 | A1* | 2/2009 | Yang | B01L 3/5027 435/287.2 |
| 2016/0167047 | A1 | 6/2016 | Weber et al. | |

FOREIGN PATENT DOCUMENTS

| | | | |
|---|---|---|---|
| DE | 102006038271 | A1 | 2/2008 |
| EP | 2169391 | A1 | 3/2010 |
| WO | 2015001070 | A1 | 1/2015 |

OTHER PUBLICATIONS

Richardson et al. "Optical and electrochemical evaluation of colloidal Au nanoparticle-ITO hybrid optically transparent electrodes and their application to attenuated total reflectance spectroelectrochemistry" (Year: 2003).*

Pollardwater.com "Signet Conductivity/Resistivity Sensors", http://pollardwater.com/pages_product/ISI32839.asp accessed through archive.org, dated Mar. 30, 2014 (Year: 2014).*

Rogers, T. Everything You Need to Know About Overmolding Prototypes, Aug. 26, 2015, https://www.creativemechanisms.com/blog/overmolding-prototype-design-development (Year: 2015).*

Erkal et al. "3D printed microfluidic devices with integrated versatile and reusable electrodes" Lab Chip, 2014, 14, 2023 (Year: 2014).*

* cited by examiner

MICROFLUIDIC FLOW CELL COMPRISING AN INTEGRATED ELECTRODE, AND METHOD FOR MANUFACTURING SAME

The present application is a 371 if International application PCT/EP2016/082748, filed Dec. 28, 2016, which claims priority of EP 161 52 755.1, filed Jan. 26, 2016, the priority of these applications is hereby claimed and these applications are incorporated herein by reference.

BACKGROUND OF THE INVENTION

The invention relates to a microfluidic flow cell comprising an electrode or sensor device which is arranged inside the flow cell and from which at least one connecting conductor is led to an externally accessible terminal contact. The invention also relates to a method for manufacturing such a flow cell.

As is known, microfluidic flow cells (labs on a chip) are increasingly being applied in so-called life sciences, for example for the analysis of body fluids, drinking water samples or other environmental samples, preferably immediately after the sampling. For example, microfluidic flow cells are also used during the examination of food samples or the cultivation, processing and analysis of cells.

An important aspect of the application of microfluidic flow cells lies in economic mass production as a disposable product. The result of this is that, during the manufacture of such flow cells, plastics and plastic processing methods are used as far as possible.

To manufacture microfluidic flow cells, for example substantially plate-like plastic parts having hollow spaces that are open toward one plate side, and the injection molded hollow spaces open on one side for the formation of fluid channels and/or reaction chambers are closed with a film. Before the connection of the injection molded plastic part with the film, for example dry reagents can be introduced into hollow spaces or channels.

A particular method for introducing dry reagents into a flow cell by means of carrier bodies receiving such reagents is described in WO 2015/001070 A1.

Particular problems result in the integration of electrodes, electric conductor tracks or sensors, the connecting conductors of which have to be led out of the regions of a flow cell forming fluid channels or/and reaction chambers, so that an electrical connection to an operating device for the flow cell can be manufactured but, at the same time, the tightness of the fluid channels is also ensured. The connecting conductors make it considerably more difficult to seal off a hollow space in the flow cell that receives the electrode or the sensor.

In order to seal off hollow spaces in which electrodes or sensors connected to connecting conductors are arranged, use is made of conventional adhesives, in particular in conjunction with double-sided adhesive tapes and soft plastic materials, elastomers or silicones as sealing material. Disadvantageously, the chemical composition of such materials is frequently (and in particular following long-term storage of the flow cell) incompatible with samples to be examined or reagents stored in the flow cell and/or these substances impair the performance of analytical reactions. This primarily relates to plasticizers contained in soft plastics. In addition, the processing of such materials, in particular silicone, is very complicated in terms of fabrication.

Electrode connecting conductor tracks applied to part of a flow cell hamper the connection of the part to a covering part, for example even a connection by laser welding, so that the height of the conductor tracks, which have to be compensated by the connecting technology for a leak-free closure of the flow cell, is limited, and inexpensive screen-printing for manufacturing electrodes and electric conductor tracks is therefore not suitable in many cases. Thin conductor tracks are sensitive, however, and, above all in the fabrication process, always subject to the risk of crack formation. In the case of adhesive tapes, there is always the risk of detachment.

Thus, the fluid-tight incorporation of electrodes or sensors connected to connecting conductors in flow cells requires great effort on fabrication.

SUMMARY OF THE INVENTION

The invention is based on the object of reducing the effort on fabrication necessary for flow cells comprising incorporated electrodes or sensors, with increased functional reliability of the flow cells.

A flow cell according to the invention, which achieves this object, is characterized in that the electrode or sensor device is arranged on an insulating carrier body, the connecting conductor is embedded in the carrier body, and the carrier body can be inserted into an opening in the flow cell with arrangement of the electrode or sensor device in the flow cell.

According to the invention, an electrode or sensor device, including externally accessible terminal conductors, is produced by a separate component that can be inserted into the flow cell.

In particular, the electrode or sensor device contacts a fluid in a hollow space within the flow cell, the opening forms a passage to the hollow space, the carrier body can be inserted into the passage in a fluid-tight manner, and the connecting conductor is embedded in a fluid-tight manner in the carrier body. While the connecting conductor can be embedded in the carrier body without difficulty, the carrier body inserted into the passage performs the further sealing of the hollow space on its own.

Preferably, the carrier body is formed in the manner of a plug having an end face receiving the electrode or sensor device and a rotationally symmetrical, in particular conical, sealing face, which preferably forms a sealing press fit with the passage to the hollow space.

In a corresponding way, the passage is preferably provided in a rigid injection molded plastic part shaped like a plate in outline, wherein the injection molded plastic part has, on its plate side facing away from the passage, depressions for forming the hollow space, preferably of channels and chambers. In order to close the hollow spaces, use is made of a film or another injection molded component connected to the flat plate surface.

A plurality of electrodes can be applied without difficulty to the end face of the carrier body, for example by screen printing, and their connecting conductors are insulated through the carrier body and led to the outside in a fluid-tight manner.

The electrodes can be made to function by coatings, for example as molecule collectors. On the other hand, by means of coating, passivation of conductor surfaces to a desired extent is possible.

Expediently, the externally accessible terminal contact is formed directly on the carrier body and provided for an operating device for the flow cell to make contact. To form a terminal contact, a connecting conductor passing through the carrier body can be widened at one end.

In a particularly preferred embodiment, the carrier body is formed with a hollow space open toward the outside, for example hat-shaped or cap-shaped.

The aforementioned terminal contact can be formed on a bottom wall of the hollow space, located opposite the hollow space opening. Connecting elements of the operating device then engage in this hollow space.

It goes without saying that the carrier body can be manufactured as an injection molded plastic part. It can consist exclusively of a plastic part or be formed as a composite part, wherein in particular the carrier wall for the electrode or the sensor, located opposite the hollow space, can be formed from a material differing from the remaining material of the carrier body, for example from ceramic.

Expediently, the carrier body has a region for manual handling or mechanical mounting. Here, this can involve, in particular, a flange projecting from the rotationally symmetrical sealing face which, in the case of a hat-shaped formation of the carrier body, forms a hat brim.

In particular in addition to a connection via a press fit, the carrier body inserted into the opening in the flow cell can furthermore be non-detachably connected to the flow cell, for example by welding or adhesive bonding.

It goes without saying that welds on the carrier body are formed at a distance from an embedded connecting conductor or/and an electrode or sensor device, in order to avoid impairing these parts by the welding.

BRIEF DESCRIPTION OF THE DRAWING

The invention is explained further below by using exemplary embodiments and the appended drawings referring to these exemplary embodiments, in which.

DETAILED DESCRIPTION OF THE INVENTION

Figure 1:
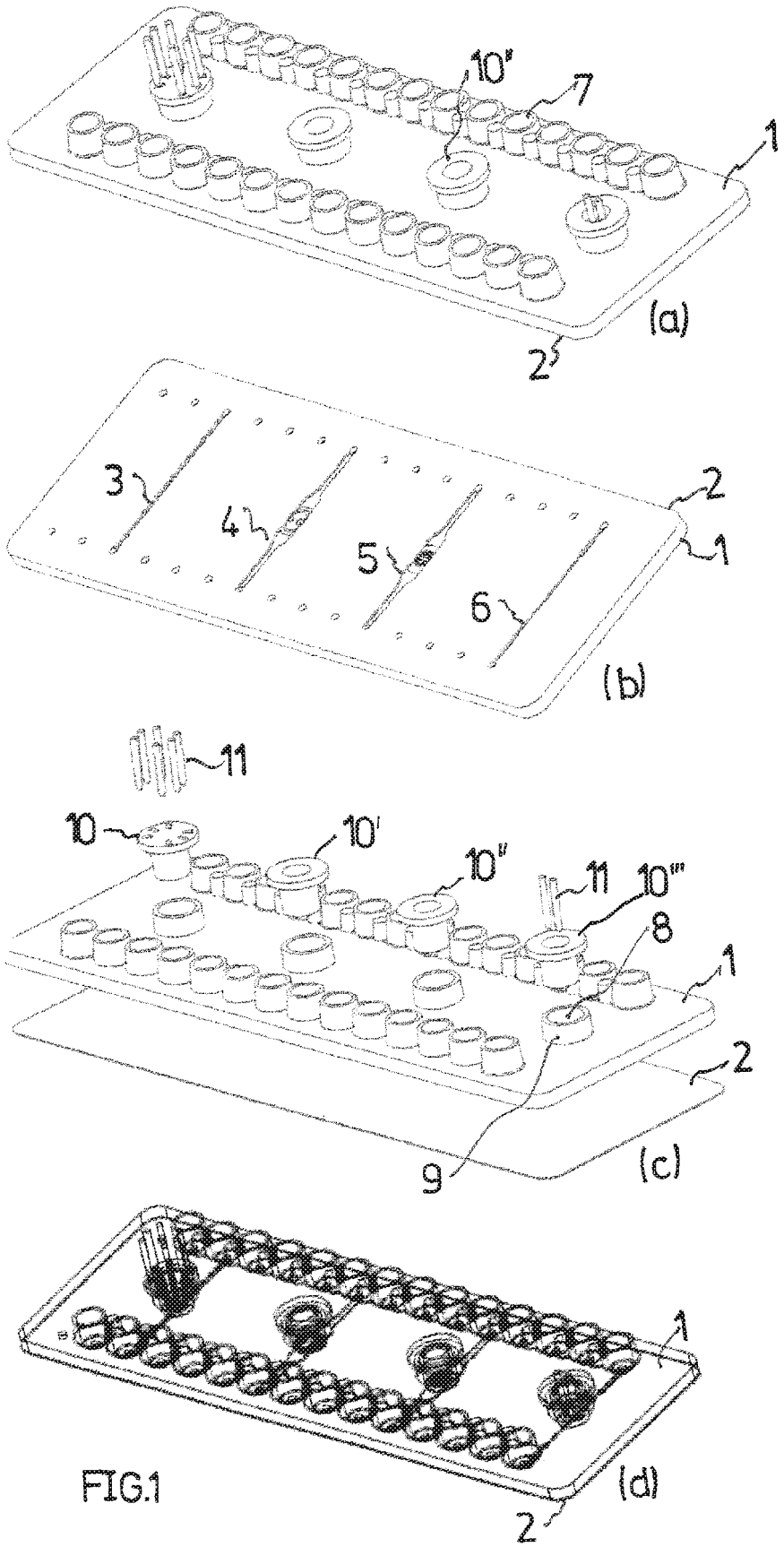
FIG. 1 shows a flow cell according to the invention in various views and illustrations.
Figure 2:
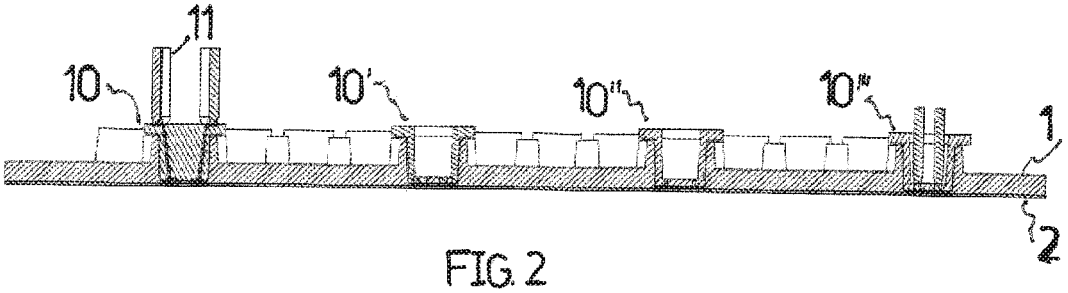
FIG. 2 shows a sectional view of the flow cell from FIG. 1, FIGS. 3 to 6 show plugs used in the flow cell of FIGS. 1 and 2 to form electrodes in the flow cell, FIG. 7 show plugs forming electrodes in various arrangements relative to hollow spaces in a flow cell.

A flow cell comprises a plate-like injection molded component 1, which, for example, consists of PMMA, PC, COC, PS, PEEK, PE or PP. The injection molded component 1 is connected on one plate side to a film 2, in particular adhesively bonded or welded. Between the injection molded component 1 and the film 2, channel structures 3, 4, 5 and 6 are formed by depressions in the injection molded component and are connected to input/output ports 7 on the side of the injection molded component 1 that faces away from the film 2. Each of the channel structures 3 to 6 is assigned a passage 8 opening to the channel structure with an input connecting piece 9 projecting from the injection molded component 1. Plugs 10, 10', 10" and 10''' are inserted into the passages 8 in a fluid-tight manner; as can be gathered from FIG. 2, the plug end face reaches respectively as far as the channel structure 3, 4, 5 and 6 and delimits the latter.

The designation 11 points to electric contact elements of an operating device (not otherwise shown), which electric contact elements are used to make contact with conductors connecting the plug, as is explained further below.

Figure 3:
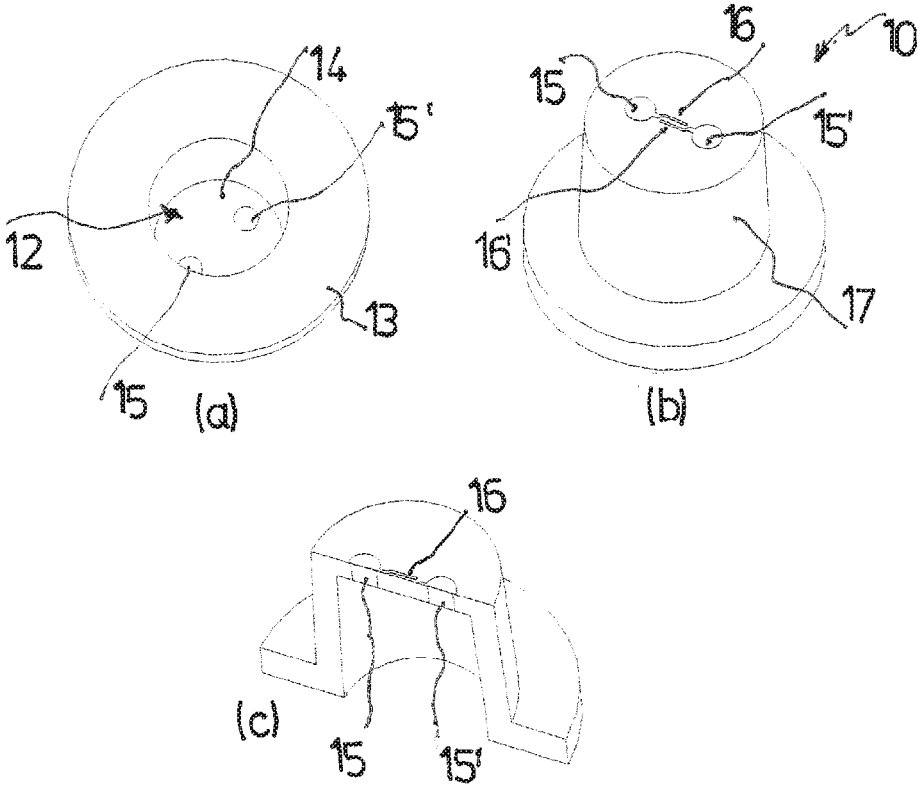

FIG. 3 shows the plug 10''' in two different views (a) and (b) and in a sectional view (c). The plug is an injection molded plastic part in basic structure, which, like the injection molded part 1, preferably consists of PMMA, PC, COC, COP, PP or PE and forms a carrier part. The cap-shaped plug 10''', formed with a hollow space 12 open on one side, has an annular flange 13 surrounding the opening of the hollow space. A bottom wall 14 located opposite the opening of the hollow space is penetrated by electrically conductive connecting conductor pieces 15 and 15'. On the inside of the plug 10''', these connecting conductor pieces each form a terminal contact for a connecting element 11 of the operating device. On the outside of the plug, the conductor pieces 15, 15' are each connected to a linear electrode 16 and 16', respectively. The electrodes 16, 16', which are elongated in the example shown and are parallel to one another, cross the channel structure 6 at right angles in the mounting position provided for the plug 10'''.

The conductor pieces 15, 15' penetrating the bottom wall 14 can be manufactured by printing, e.g. by screen printing of metal pastes such as silver paste or solders. The elongated active electrodes are preferably electrodes made of metal, in particular gold, platinum, chromium, copper or aluminum. The thickness or height of the electrodes preferably lies between 50 nm and 1 μm. For the manufacture of these electrodes, a thin layer technique or thermal transfer printing is particularly suitable. The electrodes 16, 16' crossing the channel structure 6 are each about 50 μm wide and, for example, are suitable for cell counting (on the Coulter Counter principle).

A conical sealing face 17 of the plug 10''' forms a press fit. The slope of the sealing face 17 corresponds to the Luer standard (6% slope). If necessary, the plug 10''' is additionally connected to the injection molded plastic part 1 beyond the press fit, e.g. welded.

The latter is also true of the further plugs 10 to 10", which in basic shape and basic material match the plug 10'''.

Figure 4:
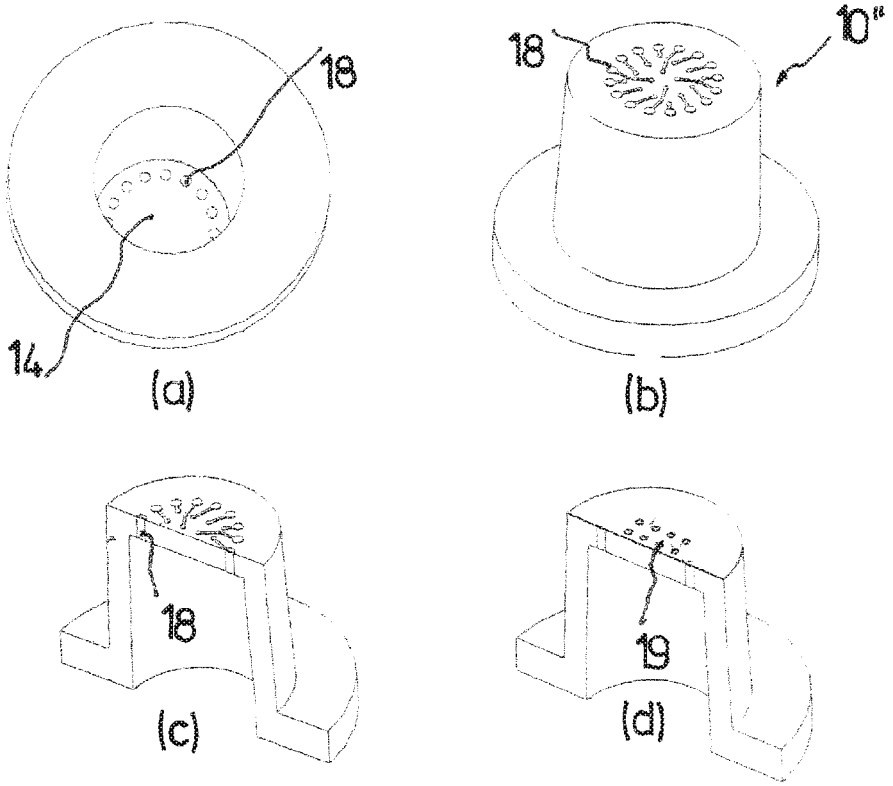

The plug 10" shown in different positions in FIGS. 4*a* and 4*b* differs from the plug 10''' In that a multiplicity of connecting conductor pieces 18 penetrating a bottom wall 14 are arranged in the bottom wall 14 in an annular arrangement. The conductor pieces 18 are each connected on their side facing the channel structure 5 to a circular electrode 19 via an elongated conductor piece, a rectangular array of such circular electrodes 19 being formed. As FIG. 4 indicates, a passivation layer ensures that of the conductor parts arranged on the bottom wall 14 only the circular conductor parts can be effective as active electrodes 19 interacting with the fluid.

Figure 5:
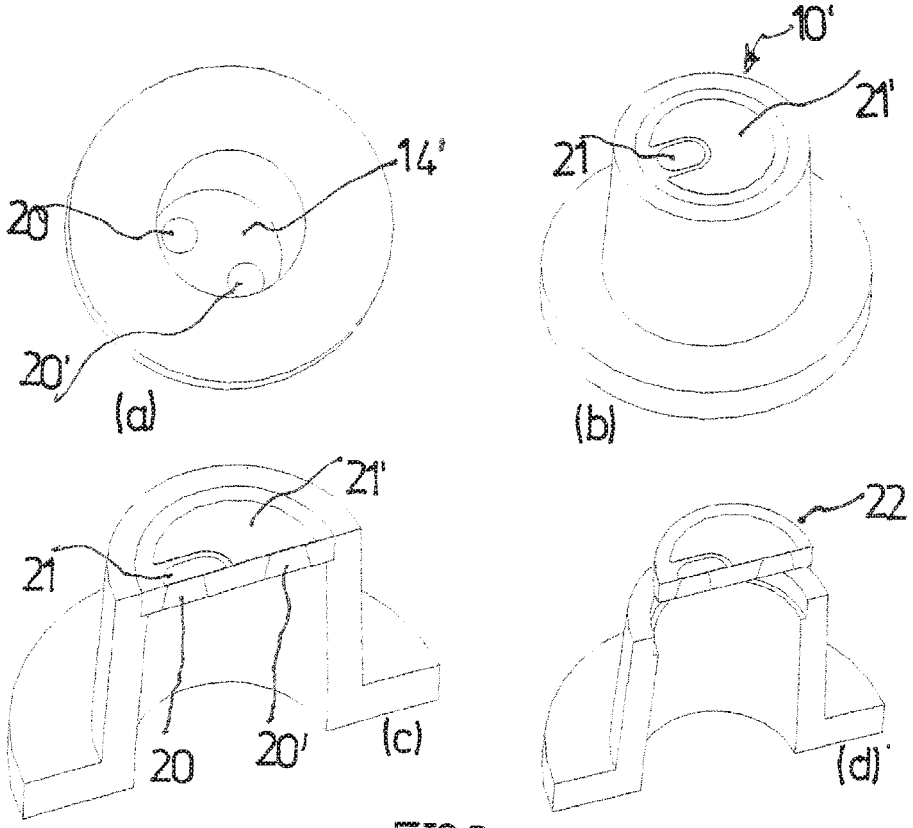

The plug 10' shown in FIG. 5 has a basic body preferably injection molded from the aforementioned plastics, wherein a bottom wall 14', for example made of ceramic, another plastic or a glass, is manufactured separately and fitted to the plastic basic body, for example by pressing in, bonding in or welding in. In the exemplary embodiment shown, the bottom wall 14' is penetrated by conically shaped connecting conductor pieces 20 which, for example, have been manufactured in the screen printing process. The conical conductor pieces 20 are connected to active electrodes 21 and 22 on the end side of the bottom wall 14', the active electrodes consisting of silver or silver chloride, for example. If necessary, they can be printed and manufactured from different metals. The two electrodes can be, for example, a measuring and a reference electrode for electrochemical investigations.

Figure 6:
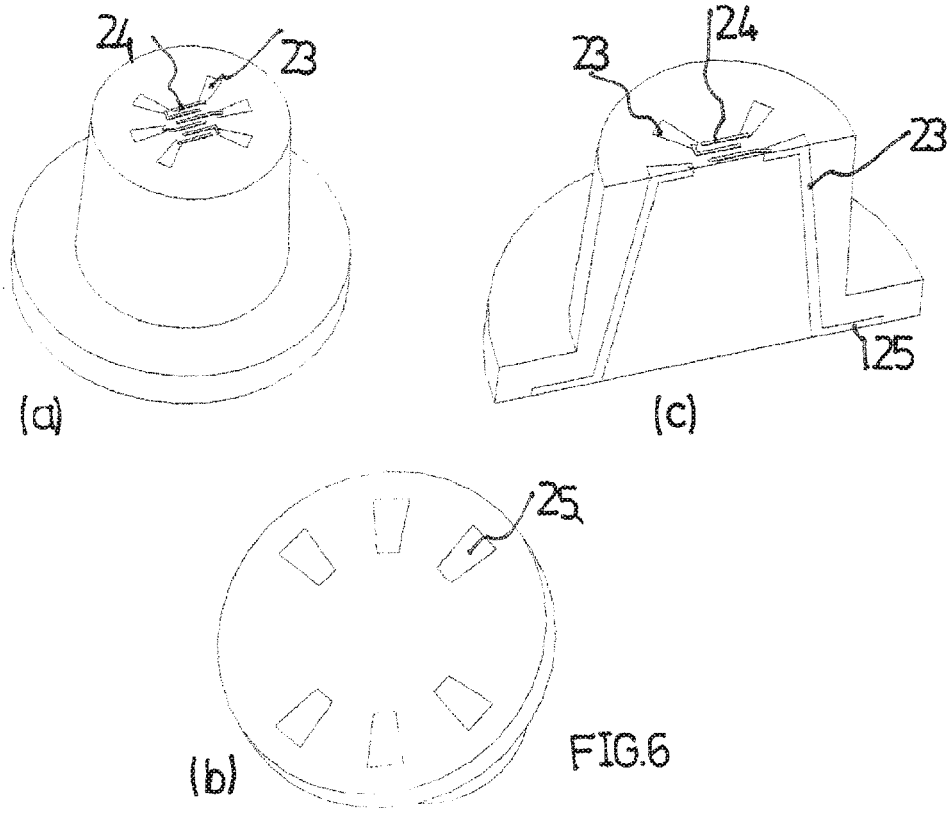

The plug 10 illustrated separately in FIG. 6 is not formed as a hollow body, like the plug described previously, but as a solid body, in which a plurality of connecting conductor pieces 23 are embedded in an annular arrangement. On the end side of the plug 10, facing the channel structure 3, the conductor pieces are each connected to straight electrodes 24 which are parallel to one another; on the outer end side of the plug the conductor pieces 23 end as widened terminal contacts 25 to be contacted by an operating device. The conductor pieces 23 are preferably formed by wires or punched and shaped metal sheets, which have been integrated in the plug 10 by overmolding during the injection molding process. The six parallel electrodes 24 cross the channel structure 3. The straight active electrodes 24 in the example shown are printed electrodes. The electrodes 24 are suitable, for example, for impedance measurements.

Figure 7:
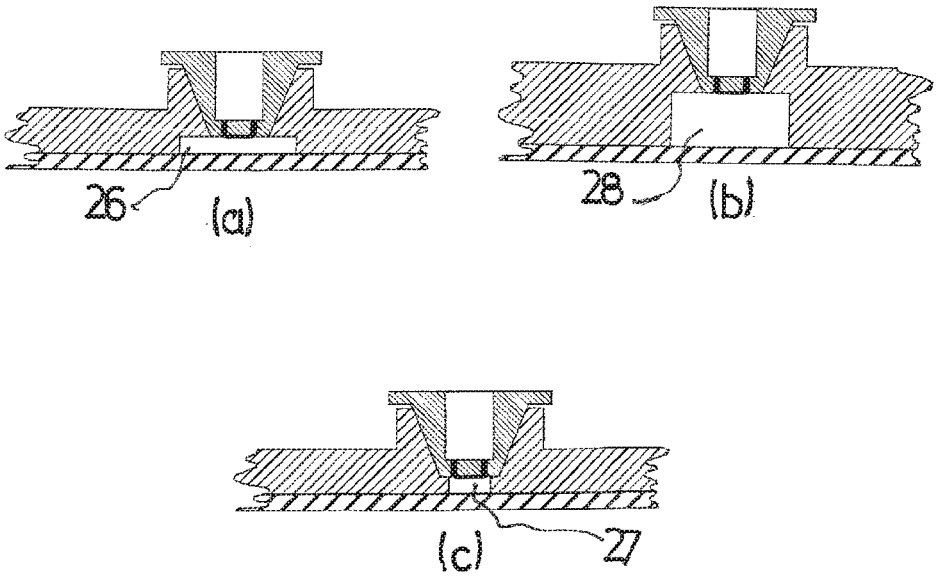

As FIG. 7 shows, a plug similar to the plugs 10',10",10'" described previously can adjoin different hollow spaces of a flow cell, for example according to FIG. 7*a*, a channel 26 which is wider than the end face of the plug facing the same or, according to FIG. 7*c*, a channel 27 which is narrower than said end side. In the latter case, the plug can be placed particularly exactly in relation to the channel 27 by the narrow channel forming contact shoulders for the end face of the plug.

In particular, the distance between the electrode and the channel base can be maintained very exactly.

FIG. 7*b* shows a plug which adjoins a reaction chamber 28 of a flow cell.

Figure 8:
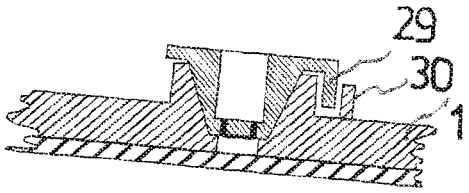
FIG. 8 shows a plug for forming an electrode having devices for positioning in a specific rotational position in a flow cell.

FIG. 8 reveals a plug which is provided with a positioning stop 29 for arranging the plug in a provided rotational position relative to the flow cell. Accordingly, an injection molded part 1 of the flow cell has a mating element 30 for the positioning stop 29.

Figure 9:
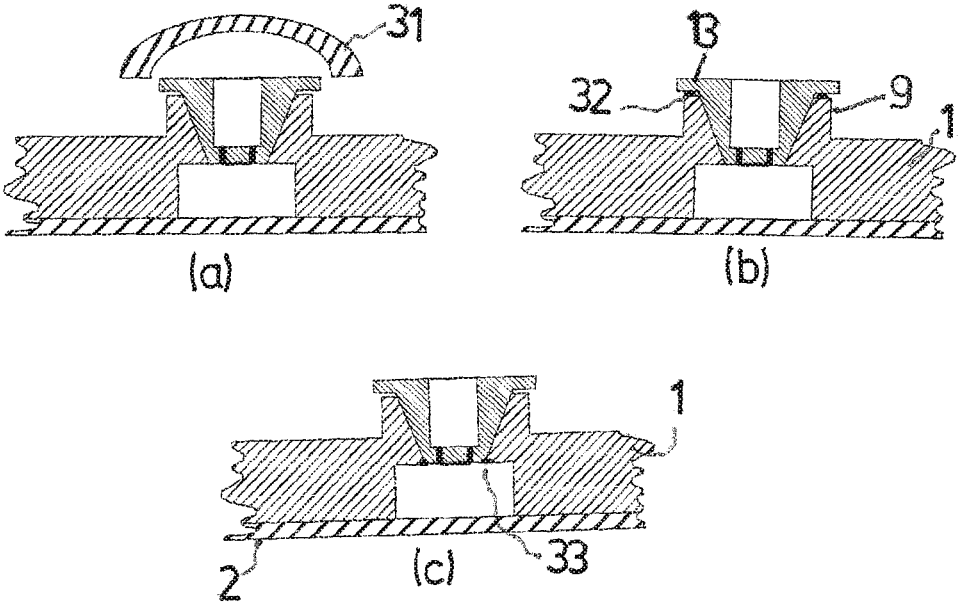
FIG. 9 shows a different possible way of connecting a plug carrying electrodes to a flow cell.

FIG. 9 shows various possible ways for the additional, non-detachable fixing of a plug inserted into a flow cell, FIG. 9*a* indicating the possibility of ultrasonic or thermal welding with the aid of a dome-shaped welding tool 31. FIG. 9*b* shows a laser weld 32 between an annular flange 13 of the plug and an inlet connecting piece 9 of an injection molded component 1, the input connecting piece 9 being formed from a plastic material which, at the wavelength of the laser light used for the laser welding, absorbs the laser radiation to a particular extent.

FIG. 9*c* shows a laser weld 33 on one side of the plug, which faces the channel area of the flow cell and which possibly has to be manufactured before the connection of any injection molded substrate 1 to a film 2. Given a sufficiently transparent film 2, the welding can also be carried out thereafter.

Figure 10:
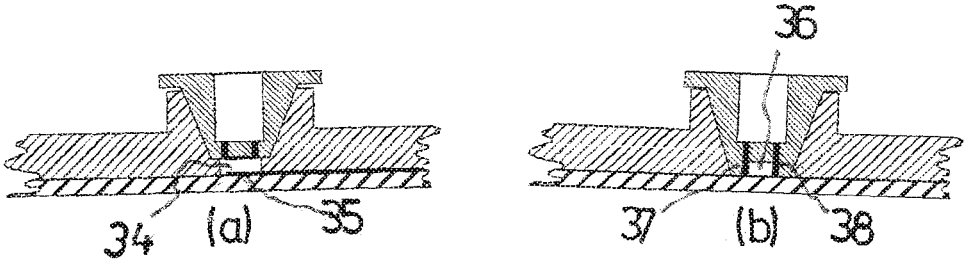
FIG. 10 shows illustrations explaining further possible ways of arranging electrodes in a flow cell.

In an exemplary embodiment shown in FIG. 10*a*, electrodes formed on a plug are combined with a further electrode 35 introduced into a channel 34 at a distance from the plug. The electrodes can interact in a suitable way, for example as mutually opposite electrodes, between which the fluid is transported in the channel of the flow cell, which opens up further possible ways of interaction.

FIG. 10*b* shows a plug, the end face of which rests on a film 2 which seals off a channel structure a channel section 36 being formed in the end face of the plug itself. Electrodes 37 and 38 connected to the plug are arranged opposite each other in the channel section 36.

Figure 11:
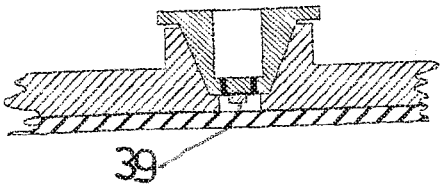
FIG. 11 shows a flow cell comprising a plug carrying a sensor.

FIG. 11 shows an exemplary embodiment of a plug, on the end face of which, facing a channel, a sensor 39 is arranged. The conductor sections passing through the end wall form terminal conductors for the sensor which, for example, is manufactured means of semiconductor technology or other methods, for example from microelectronics.

Figure 12:
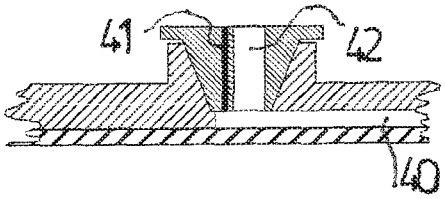
FIG. 12 shows a flow cell comprising an electrode for producing an electric field used for electrophoresis.

FIG. 12 reveals a plug which, in the example shown, is located at the end of a channel 40 which is filled with a fluid which is analyzed by means of capillary electrophoresis. At the other, not visible, end of the channel 40, there is a further plug, corresponding to the plug shown and having an electrode 41. The electrodes 41 of the two plugs generate an electric field of some $10^3$ volts, in which the molecules in the fluid move at different: speeds because of their size, so that "separation" takes place. To some extent, high temperatures occur, which permit the fluid to gas out. The plugs therefore each have a de-gassing channel 42.

Figure 13:
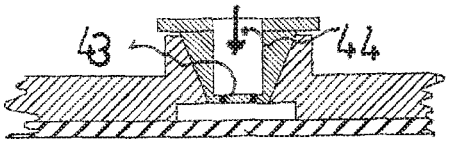
FIG. 13 shows a flow cell comprising a plug which has a flexible carrier wall for an electrode.

FIG. 13 shows a plug formed as a hollow body having an end wall 43, which is not injection molded like the other plugs but is formed by a separate film having continuous conductor pieces and functional electrodes on the end side. The film welded to the other plug is flexible and can be deflected into the channel area in accordance with arrow 44 by means of mechanical or pneumatic actuation by an operating device. As a result of such a deflection, the interaction between the electrodes and a sample fluid to be analyzed or to be processed can be intensified.

Figure 14:
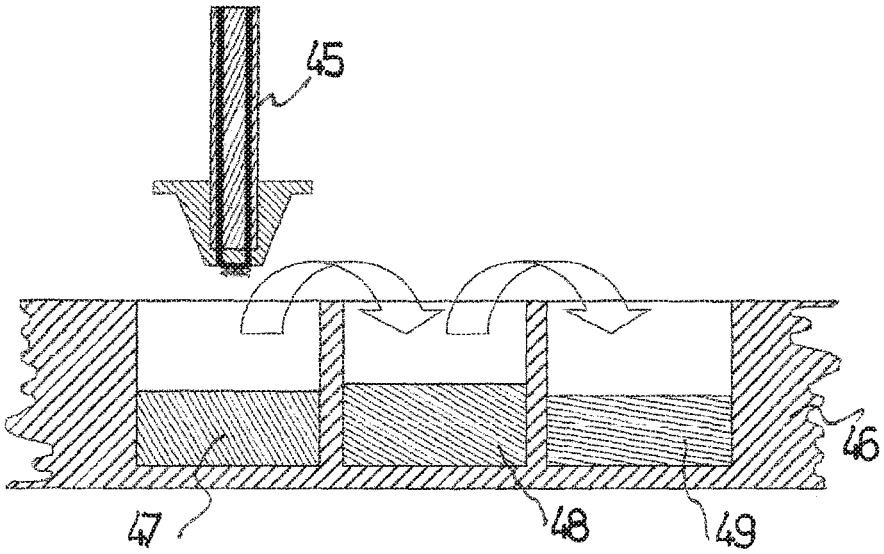
FIG. 14 shows an illustration explaining further possible applications of an electrode carrier plug according to the invention.

FIG. 14 reveals a use, independent of a flow cell, of plugs having electrodes. A handling device 45 having embedded terminal conductors is clamped into a hollow space of the plug, said terminal conductors having contact with electrodes on the end side of the plug, facing away from the handling device. The electrodes can be functionalized, for example with antibodies. The plug is immersed into a sample 47 contained, for example, in a microtiter plate or another sample vessel 46, wherein, for example, analytes are deposited on the plug. The deposition can be assisted by stirring movements. After that, the plug is immersed in a washing solution 48, for example. Finally, the plug can be transferred into a detection reagent 49, which permits the electrodes to be read electrically. The plug could also have magnetic or electromagnetic devices and be provided for the use of functionalized magnetic beads as an alternative to antibodies applied directly to the plug. Here, the magnetic beads can also be discharged into the respective liquids and be picked up again for onward transport by electromagnetic activation of the plug.

Figure 15:
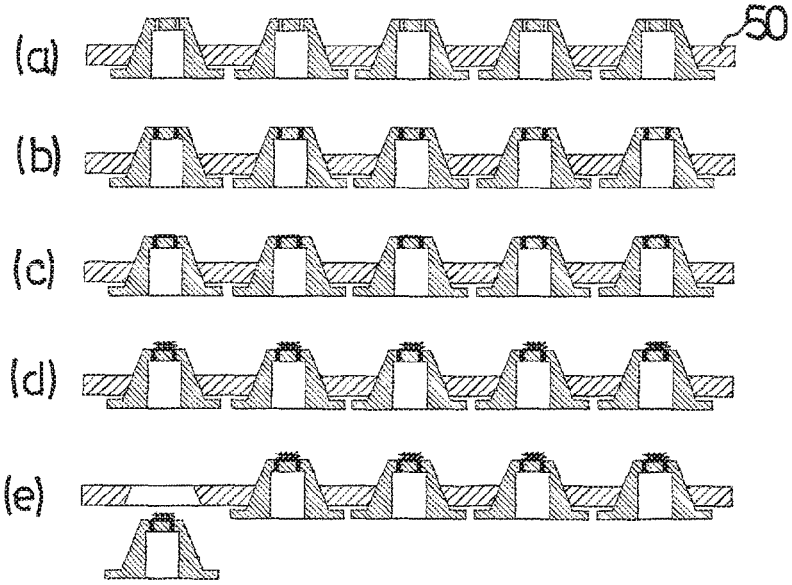
FIG. 15 shows an illustration explaining the logical fabrication of an electrode carrier plug.

FIG. 15 indicates how plugs with electrodes can be manufactured efficiently. The carrier bodies manufactured by injection molding can be put into magazines, according to FIG. 15*a*, and, for example in numbers of 10 to 1000, hold components in defined positions on a carrier 50.

In a following step (FIG. 15*b*), through-contact is made, for example by a printing process such as screen printing. Alternatively, separate end walls made of silicon glass, ceramics or plastic could be applied.

In a third step, according to FIG. 15*c*, the formation of functional electrodes is carried out, for example by printing processes such as screen printing or by means of thin layer processes or by means of laser processes.

In a fourth step (FIG. 15*d*), the plugs put into magazines in large numbers can undergo surface functionalization, for example by means of antibodies or dry reagents or functionalized beads. This can be done by pipetting and subsequent drying. Alternatively, a passivation layer can be applied by means of a printing or thin layer process.

Only in a last step (FIG. 15*e*), for example before assembly, must individualization of the plugs be carried out with removal from the magazine.

The invention claimed is:

1. A microfluidic flow cell, comprising:

an injection molded insulating carrier body; an electrode or sensor device arranged inside the flow cell; and at least one connecting conductor arranged to lead from the electrode or sensor device to an externally accessible terminal contact, wherein the electrode or sensor device is arranged on the carrier body, the at least one connecting conductor is embedded fluid-tight in the carrier body by injection molding of the carrier body, wherein the externally accessible terminal contact is arranged on the carrier body, and the carrier body is insertable fluid-tightly into an opening in the flow cell with arrangement of the electrode or sensor device in the flow cell, wherein the carrier body is a hollow body having a hollow space open outwardly relative to the flow cell so as to permit deflection of the electrode and transportation of the carrier body.

2. The flow cell according to claim 1, further comprising a fluid in a hollow space within the flow cell, wherein the electrode or sensor device contacts the fluid, the opening forming a passage to the hollow space, the carrier body being insertable into the passage in a fluid-tight manner.

3. The flow cell according to claim 2, wherein the carrier body is formed as a plug having an end face and a rotationally symmetrical sealing face.

4. The flow cell according to claim 3, wherein the sealing face is conical.

5. The flow cell according to claim 3, wherein the sealing face forms a press fit with the passage.

6. The flow cell according to claim 1, wherein the electrode or sensor device is arranged on an end face of the carrier body.

7. The flow cell according to claim 1, wherein the terminal contact is formed on the carrier body and is provided for an operating device for the flow cell to make contact.

8. The flow cell according to claim 1, wherein the terminal contact is formed on a bottom wall of the hollow space, located opposite the hollow space opening.

9. The flow cell according to claim 3, wherein the carrier body has a region for manual handling or mechanical mounting.

10. The flow cell according to claim 9, wherein the region is a flange projecting from the rotationally symmetrical sealing face.

11. The flow cell according to claim 1, wherein the carrier body inserted into the opening is non-detachably connected to the flow cell.

12. The flow cell according to claim 11, wherein the carrier body is welded or adhesively bonded to the flow cell.

13. The flow cell according to claim 12, wherein a weld on the carrier body is formed at a distance from the embedded connecting conductor or/and the electrode or sensor device.

14. The flow cell according to claim 1, wherein the electrode is functionalized.

15. The flow cell according to claim 1, wherein the electrode is partly passivated and/or the connecting conductor connected to the electrode is passivated by a coating.

16. A plug having an electrode or sensor device for a flow cell according to claim 1.

17. A method for forming an electrode contacting a fluid in a hollow space of a flow cell, comprising the steps of: arranging the electrode on a carrier having a hollow carrier body with a hollow space open outwardly relative to the flow cell so as to permit deflection of the electrode and transportation of the carrier body; and inserting the carrier in a fluid-tight manner into a passage of the flow cell that leads to the outside from the hollow space so that the electrode is arranged in the hollow space.

* * * * *